US005917465A

United States Patent [19]

Mochizuki et al.

[11] Patent Number: 5,917,465

[45] **Date of Patent: *Jun. 29, 1999**

[54] DISPLAY UNIT EMPLOYING PHASE TRANSITION LIQUID CRYSTAL AND METHOD OF DRIVING THE DISPLAY UNIT

[75] Inventors: Akihiro Mochizuki; Shigeo Kasahara; Tetsuya Makino; Masashi Watanabe, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/791,948

[22] Filed: Jan. 31, 1997

Related U.S. Application Data

[63] Continuation of application No. 08/586,484, Jan. 16, 1996, abandoned, which is a continuation of application No. 08/401,301, Mar. 9, 1995, abandoned, which is a continuation of application No. 08/251,656, May 31, 1994, abandoned, which is a continuation of application No. 08/113,912, Aug. 31, 1993, abandoned.

[30] Foreign Application Priority Data

Mar. 17, 1993 [JP] Japan ..... 5-57222

[51] Int. Cl.[6] ..... G09G 3/36

[52] U.S. Cl. ..... 345/94; 349/33

[58] Field of Search ..... 345/94–96; 349/33, 349/34, 37, 42

[56] References Cited

U.S. PATENT DOCUMENTS

| | | | |
|---|---|---|---|
| 4,048,633 | 9/1977 | Sano | 345/94 |
| 4,288,147 | 9/1981 | Koch . | |
| 4,818,981 | 4/1989 | Oki et al. | 345/94 X |
| 4,856,081 | 8/1989 | Smith | 340/825.57 |
| 5,014,048 | 5/1991 | Knapp | 345/94 X |
| 5,105,288 | 4/1992 | Senda et al. | 345/94 X |
| 5,181,133 | 1/1993 | Lipton | 345/94 X |
| 5,260,699 | 11/1993 | Lister et al. | 359/84 X |

OTHER PUBLICATIONS

Mochizuki et al., "Study of Liquid Crystal Materials for Storage–Type LCDs Driven by C–MOS LSIs," *Ind. Eng. Chem. Prod. Res. Dev.,* vol. 23, No. 4, 1984, reprinted with permission by the American Chemical Society, pp. 609–612.

Mochizuki et al., "A Nematic–Cholesteric Bistable Liquid Crystal Display for Projectors," *Proceedings of SPIE,* reprinted from vol. 760—Large Screen Projection Displays, Jan. 15, 1987, Los Angeles, CA, pp. 74–77.

Mochizuki et al., "A 1120×768 Pixel Four–Color Double–Layer Liquid–Crystal Projection Display," *Proceedings of the SID,* reprinted from vol. 31, No. 2, 1990, pp. 155–161.

Mochizuki et al., "Surface Effect on the Threshold Electric Fields of Cholesteric–Nematic Phase Transition and Its Reverse Process," *Mol. Cryst. Liq. Cryst.,* vol. 225, 1993, pp. 89–98.

Mochizuki, et al., "An Electric Bilayer Model of the Transient Current in a Nematic Liquid Crystal Cell"; Japanese Journal of Applied Physics, vol. 29, No. 2, Feb. 1990, pp. L322–L325.

*Primary Examiner*—Amare Mengistu
*Attorney, Agent, or Firm*—Staas & Halsey

[57] ABSTRACT

A method of driving a liquid crystal display (LCD). The LCD employs a phase transition liquid crystal. An AC waveform drives the liquid crystal. Pauses, which represent periods in which zero volts are applied to the LCD, are inserted into the AC waveform to attenuate the internal electric fields produced by the electric field reactions of molecules in the phase transition liquid crystal. This method allows thin film transistors to drive the phase transition liquid crystal, thus realizing a projection LCD that employs no polarizing film and is bright and stable.

30 Claims, 14 Drawing Sheets

G1
G2
L1
L2
L3
LQ
F
H
H'
POLARIZATION LIQUID CRYSTAL LAYER
NORMAL LIQUID CRYSTAL LAYER
POLARIZATION LIQUID CRYSTAL LAYER

G1
L1
L2
L3
G2
EXTERNAL ELECTRIC FIELD
EE
POLARIZATION

G1
L1
L2
L3
G2

G1
L1
L2
L3
G2

DISPLAY UNIT EMPLOYING PHASE TRANSITION LIQUID CRYSTAL AND METHOD OF DRIVING THE DISPLAY UNIT

This application is a continuation of application Ser. No. 08/586,484, filed on Jan. 16, 1996, now abandoned, which is a continuation of application Ser. No. 08/401,301, filed on Mar. 9, 1995, now abandoned, which is a continuation of prior application Ser. No. 08/251,656, filed on May 31, 1994, now abandoned, which is a continuation of prior application Ser. No. 08/113,912, filed on Aug. 31, 1993, now abandoned.

BACKGROUND OF THE INVENTION

1. Field of the Invention

The present invention relates to an LCD (liquid crystal display) and a method of driving the same, and particularly, to an LCD employing a phase transition liquid crystal and a method of driving the LCD.

2. Description of the Related Art

LCD display units are frequently used in office automation equipment such as personal computers and word processors. As office automation advances, the LCDs are required to have a higher information content, a higher response speed, a wider viewing angle, a brighter screen, and an ability to display high-quality color images. Recently, projection LCDs have attracted attention because it is relatively easy for such LCDs to provide a large-sized image.

The projection LCDs presently marketed are TN (twisted nematic) LCDs employing TFTs (thin film transistors). The TFT LCDs are capable of applying a sufficient voltage to each pixels so that they theoretically achieve a high response speed and sufficient intensity levels required for displaying video images. The TFT LCDs are expected to serve as large full-color projection display units.

Conventional projection TFT-TN-LCDs, however, must employ a polarizing film, which darkens the projected image. The polarizing film absorbs light from a light source and changes it into heat, so that the projection TFT-TN-LCDs provide not only dark images but also low contrast due to the heat if the LCDs are insufficiently cooled. It is preferable, therefore, to drive the projection LCDs without using the polarizing film but using of the transmission and scattering of light.

The transmission-scattering LCDs employing no polarizing film are dynamic scattering LCDs, phase transition LCDs, and polymer dispersion LCDs (PDLCs).

The dynamic scattering LCDs employ a current effect to drive liquid crystal. Accordingly, they cannot be driven with amorphous silicon TFTs because of insufficient electron mobility.

The polymer dispersion LCDs use a driving voltage of several tens of volts so that they are not yet in practical use.

On the other hand, the phase transition LCDs are capable of providing bright display images without polarizing films. The driving voltage of the phase transition LCDs is 25 to 30V, which is about half of the driving voltage of the polymer dispersion LCDs. In addition, the phase transition LCDs employ an electric field effect, so that they may in principle be driven with amorphous silicon TFTs.

It is understood, therefore, that the LCDs employing phase transition liquid crystal overcome the drawbacks of the TFT-TN-LCDs and serve full-color projection LCDs that provide high-quality images. The phase transition LCDS, however, have the problems mentioned below so that quality images are not provided.

Namely, the conventional LCDs employing phase transition liquid crystal have the following problems to be solved:

(1) The phase transition LCDs involve a relatively high driving voltage of 25 to 30V, so that they cannot be driven by practical amorphous silicon TFTs whose driving voltage is about 10V.

(2) Changing the phases of the phase transition liquid crystal from one to another involves electro-optic hysteresis, which puts a limit on intensity levels in the displayed images.

(3) When the liquid crystal material is changed to another that can be driven at about 10V, substantially no contrast will be produced.

(4) When the liquid crystal material is changed to another that can be driven at about 10V, the long response time will not allow video images to be displayed.

SUMMARY OF THE INVENTION

An object of the present invention is to provide an LCD employing a phase transition liquid crystal and no polarizing film, the LCD properly serving as a bright and stable projection LCD.

According to the present invention, there is provided a method of driving a liquid crystal display employing phase transition liquid crystal, comprising the step of inserting pauses in an AC waveform, which alternatingly drives the liquid crystal, to relax the internal electric fields produced by the electric field reactions of molecules in the liquid crystal.

The pauses may be inserted while a sustain pulse is being applied after a write pulse. Note, driving voltage limiting periods may be inserted just before the pauses, to limit the peak values of the driving waveform. Further, driving voltage limiting periods may be inserted just after the pauses, to limit the peak values of the driving waveform. The voltage levels in the driving voltage limiting periods may be intermediate values of the peak values of the AC driving waveform.

According to the present invention, there is also provided a liquid crystal display having a first glass substrate, a second glass substrate, phase transition liquid crystal sealed between the first and second glass substrates, and thin film transistors for driving the liquid crystal, wherein the liquid crystal display comprises an AC drive unit for alternatingly driving the liquid crystal; and a relaxing unit for relaxing internal electric fields produced when molecules of the liquid crystal react to an electric field at each of interfaces between the first and second glass substrates and the liquid crystal. The relaxing unit inserts pauses in an AC waveform for driving the liquid crystal, to relax the internal electric fields.

The pauses may be inserted while a sustain pulse is being applied after a write pulse. Note, driving voltage limiting periods may be inserted just before the pauses, to limit the peak values of the driving waveform. Further, driving voltage limiting periods may be inserted just after the pauses, to limit the peak values of the driving waveform. The voltage levels in the driving voltage limiting periods may be intermediate values of the peak values of the AC driving waveform.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

A principle of an LCD according to the present invention will be explained with reference to the drawings.

Figure 1:
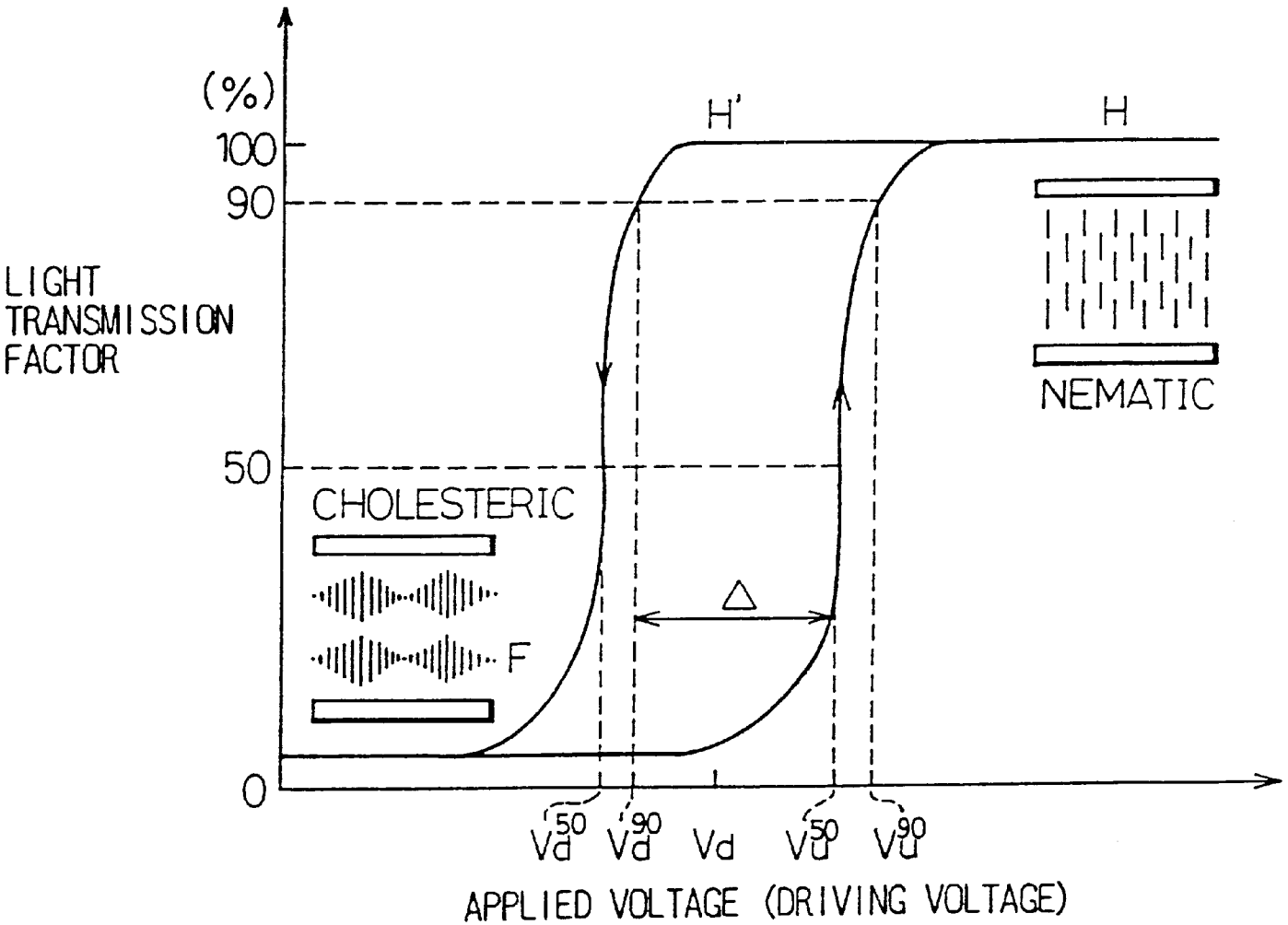
FIG. 1 (PRIOR ART)
FIG. 1 explains hysteresis of phase transition liquid crystal.

FIG. 1 shows the relationship between a light transmission factor and an applied driving voltage, to explain hysteresis in phase transition liquid crystal.

Figures 2A, 2B, 2C:
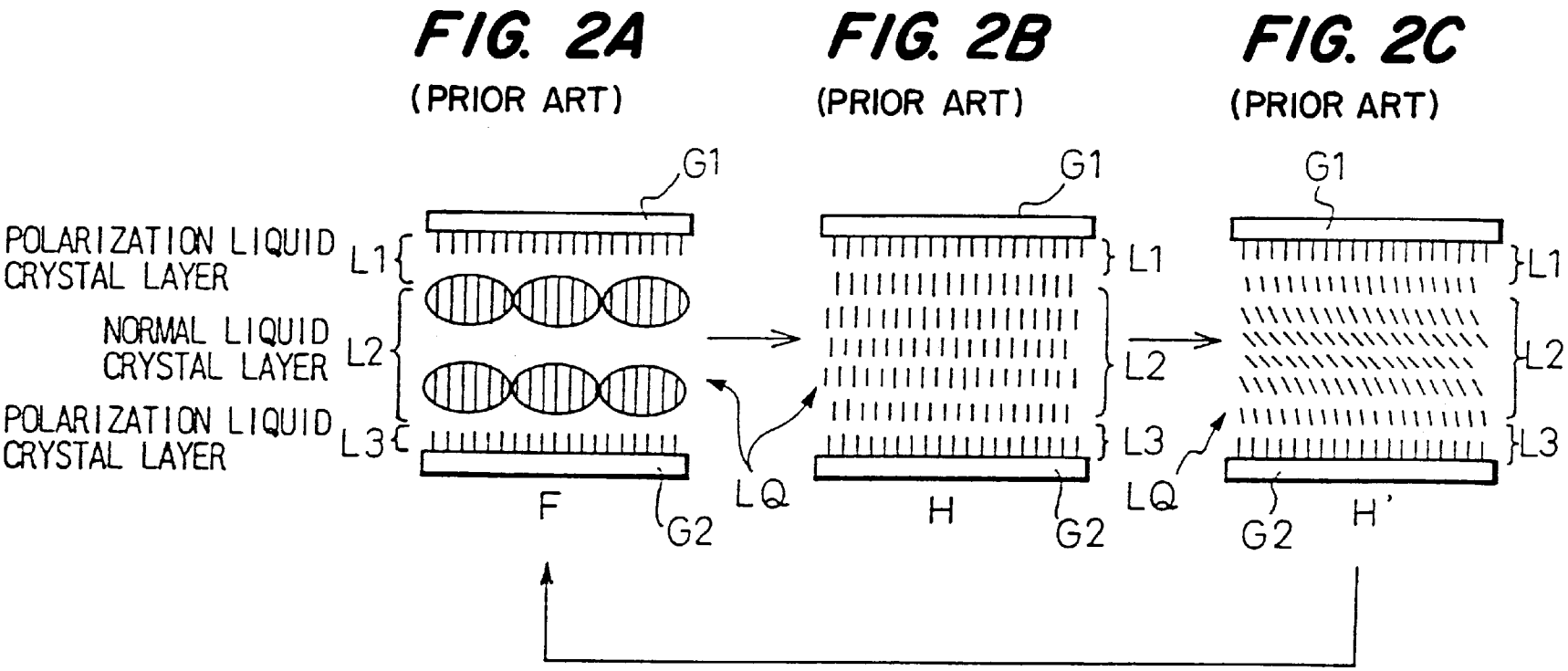
FIG. 2A (PRIOR ART)
FIG. 2B (PRIOR ART)
FIG. 2C (PRIOR ART)
FIGS. 2A to 2C are sectional views showing the phases of an LCD panel employing the phase transition liquid crystal.

FIGS. 2A to 2C are sectional views explaining different phases of the phase transition liquid crystal that forms an LCD panel, in which FIG. 2A shows a cholesteric phase F, FIG. 2B shows a nematic phase H, and FIG. 2C shows a metastable state, i.e., a transition state H' between the cholesteric and nematic phases.

In FIG. 1, reference marks Vd90 and Vd50 indicate applied voltages to achieve light transmission factors of 90% and 50%, respectively, during transition from the nematic phase H to the cholesteric phase F. Reference marks Vu90 and Vu50 indicate applied voltages to achieve light transmission factors of 90% and 50%, respectively, during transition from the cholesteric phase F to the nematic phase H.

In FIGS. 2A to 2C, reference marks G1 and G2 are glass substrates for holding the phase transition liquid crystal LQ. L1 and L3 are polarization liquid crystal layers that are affected by an interfacial effect due to the glass substrates G1 and G2. L2 is a normal liquid crystal layer.

In FIG. 1, the electro-optic response of the phase transition liquid crystal is hysteretic. The hysteresis is caused by the level of an externally applied voltage, i.e., the strength of an externally produced electric field is not directly transmitted to the liquid crystal inside the LCD panel because there is an interfacial anchoring effect to anchor the liquid crystal molecules.

The inventors have carefully examined the nematic-cholesteric phase transition and found that, when an electric field is applied to change the phase of the phase transition liquid crystal, a hysteresis occurs because internal electric fields are produced in the liquid crystal in addition to the externally applied electric field (voltage). Namely, in the metastable phase H' of FIG. 1, the externally applied voltage is insufficient to produce an electric field strength to maintain the nematic phase in which the liquid crystal is transparent. In spite of this fact, the liquid crystal is kept transparent because the liquid crystal has internal electric fields that reinforce the externally produced electric field.

When the scattering cholesteric phase is changed to the transparent nematic phase, however, the internal electric fields adversely act to weaken the externally applied voltage (electric field). Accordingly, an electric field that is stronger than an originally required electric field must be applied to the liquid crystal, to change the cholesteric phase into the nematic phase. Namely, the internal electric fields work to increase an applied driving voltage.

In the cholesteric phase F of FIG. 2A, the liquid crystal molecules in the normal layer L2 have a helical structure. The center axis of the helical structure runs in parallel to the surface of the glass substrates G1 and G2, to scatter light and to thereby make the liquid crystal opaque.

In the nematic phase H of FIG. 2B, the liquid crystal molecules in the normal layer L2 have a homeotropic structure in which the liquid crystal molecules are orthogonal to the glass substrates G1 and G2, so that the liquid crystal becomes transparent.

In the metastable state (transition state) H' of FIG. 2C, the liquid crystal molecules in the normal layer L2 are orthogonal to the glass substrates G1 and G2, similar to the nematic phase H. In the middle of the normal layer L2, however, the liquid crystal molecules are slightly inclined.

As shown in FIGS. 2A to 2C, the liquid crystal molecules in the polarization layers L1 and L3 act differently to those in the normal layer L2. Namely, the liquid crystal molecules in the polarization layers L1 and L3 that are formed in the vicinity of the interfaces between the glass substrates G1 and G2 and the liquid crystal act differently to those in the normal layer L2 that is formed in the middle of the thickness of the LCD panel. The normal layer L2 determines the electro-optic response of the LCD.

Figure 3:
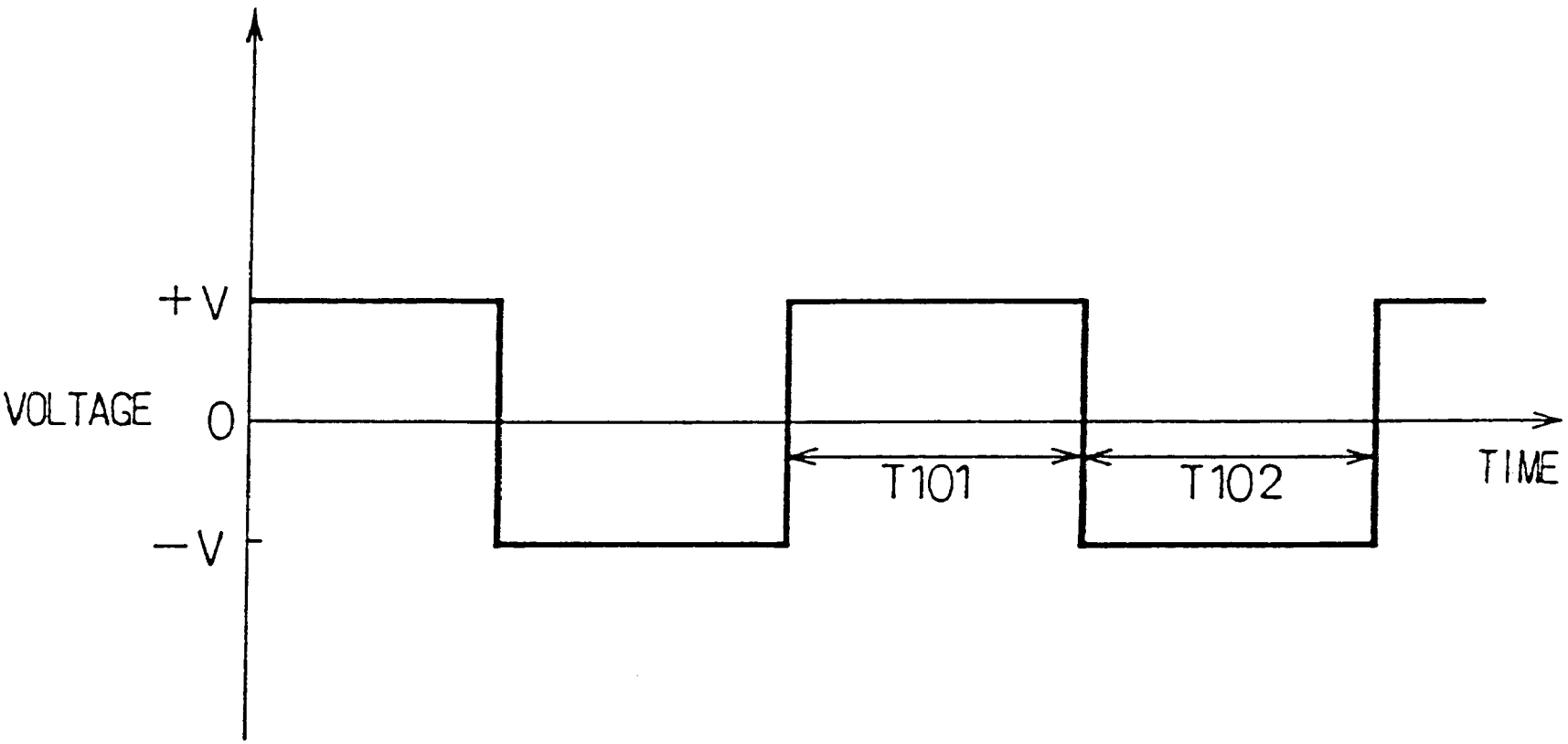
FIG. 3 (PRIOR ART)
FIG. 3 shows a waveform for driving an LCD according to a prior art.

FIG. 3 shows an example of a conventional waveform for driving an LCD. The waveform is an alternating rectangular wave. When the waveform of FIG. 3 drives the phase transition LCD of FIG. 2, the polarization layers L1 and L3 in the vicinity of the interfaces produce internal electric fields as shown in FIGS. 4A to 4C.

Figures 4A, 4B, 4C:
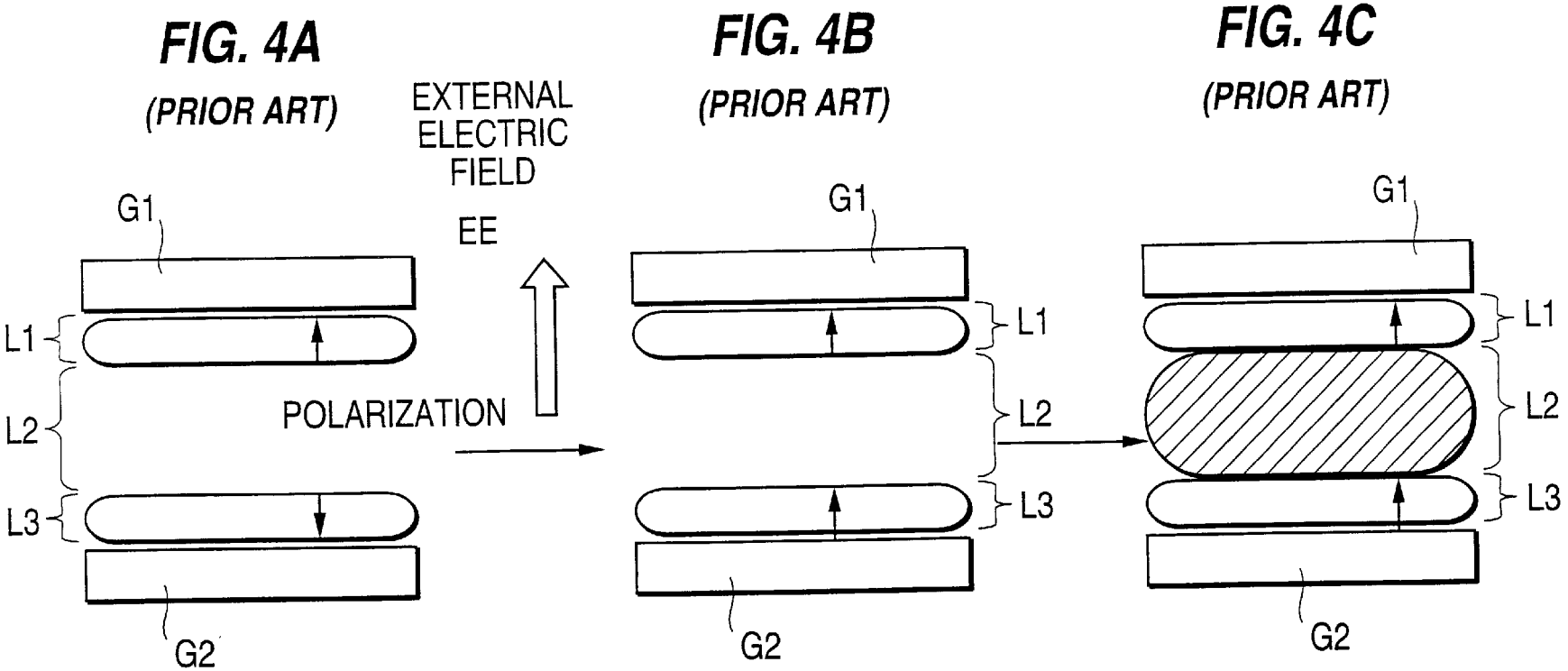
FIG. 4A (PRIOR ART)
FIG. 4B (PRIOR ART)
FIG. 4C (PRIOR ART)
FIGS. 4A to 4C explain the problems of the prior art.

The problems of the conventional phase transition LCD will be explained with reference to FIGS. 4A to 4C, in which FIG. 4A is an initial state in which electric fields in the polarization layers L1 and L3 are opposite to each other, FIG. 4B is a state of driving the LCD by applying a positive voltage for a period T101 of FIG. 3 to the LCD, and FIG. 4C shows a state of driving the LCD by applying a negative voltage for a period T102 of FIG. 3 to the LCD after the completion of the application of the positive voltage.

When the voltage applied to the phase transition LCD is inverted in the periods T101 and T102 of FIG. 3, the polarization layers L1 and L3 produce counter electric fields in the LCD panel due to the polarity inversion caused by the external electric field. Accordingly, the normal layer L2 that determines an electro-optic response receives an electric field of EE-Ed, where EE represents the externally applied electric field and Ed represents the counter electric fields produced by the polarization layers L1 and L3.

Namely, to change the phase transition liquid crystal from the cholesteric phase F to the nematic phase H, a high voltage, i.e., a strong electric field exceeding the counter electric fields (Ed) caused by the polarization layers L1 and L3 is required.

The counter electric fields are produced due to polarity inversion, and rapidly attenuate in a standard LCD panel. When driving the LCD with a continuous rectangular wave such as one shown in FIG. 3, drive pulses of opposite polarities are applied before the counter electric fields completely attenuate. As a result, the liquid crystal layer L2 in the middle of the panel receives the electric field of EE-Ed. Namely, a high external voltage must be applied to the LCD.

Figure 5:
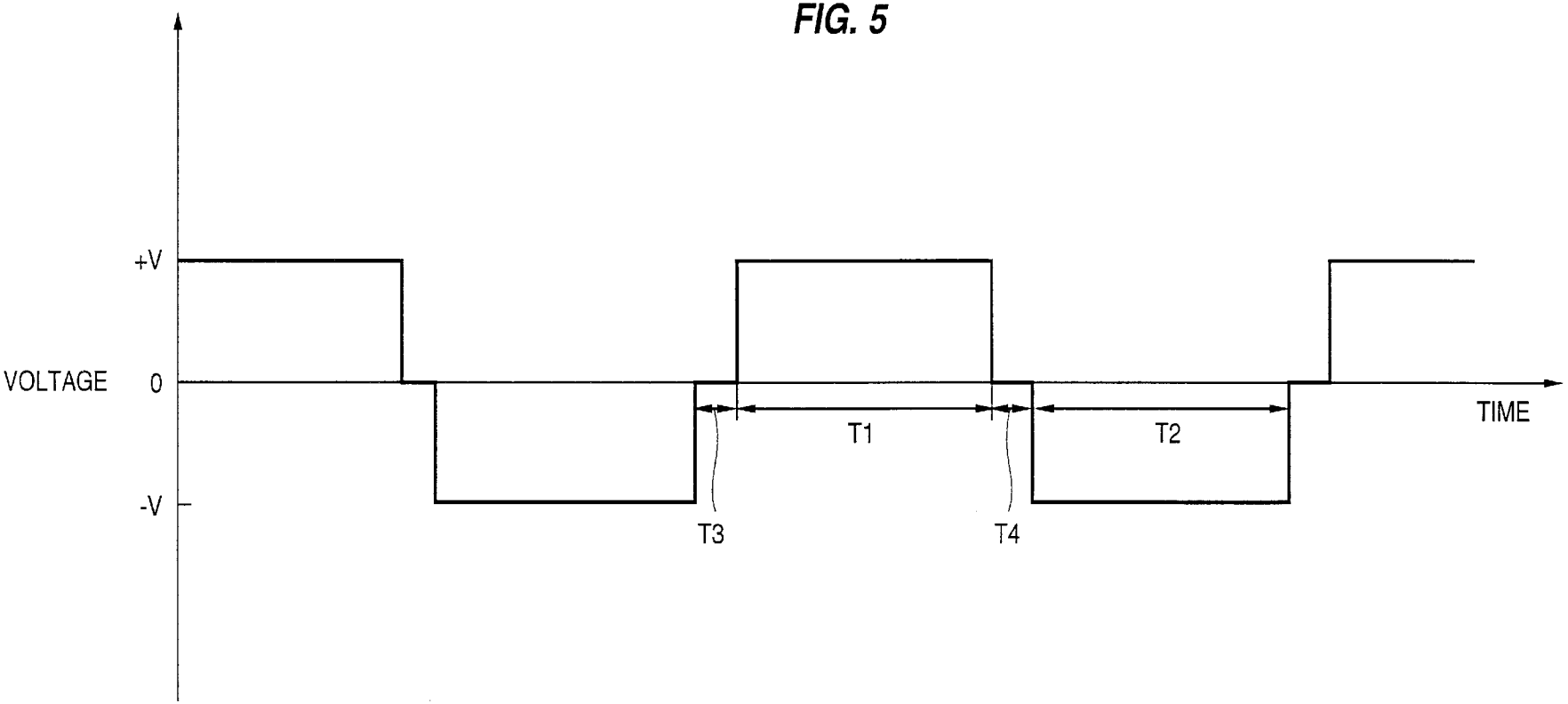
FIG. 5 shows a waveform for driving an LCD according to an embodiment of the present invention.

FIG. 5 shows a waveform for driving an LCD according to an embodiment of the present invention. A reference mark T1 is a period of positive driving voltage corresponding to the period T101 of FIG. 3. During the period T1, the positive voltage is applied to the phase transition LCD panel. The reference mark T2 indicates the a period of a negative driving voltage corresponding to the period T102 of FIG. 3. During the period T2, a negative voltage is applied to the phase transition LCD panel. A pause T3 is inserted between the negative voltage driving period T2 and the positive voltage driving period T1, and a pause T4 is inserted between the positive driving period T1 and the negative driving period T2.

In this way, the embodiment of FIG. 5 inserts the pauses T3 and T4 in the AC waveform for driving the phase transition LCD. The pauses T3 and T4 are inserted in a sustain pulse after a write pulse, to attenuate the internal counter electric fields caused by the polarization layers. As a result, the externally applied voltage is applied as it is to the normal layer L2 that produces the electro-optic response.

As explained above, the polarization layers L1 and L3 are present at interfaces between the glass substrates G1 and G2 and the phase transition liquid crystal. Liquid crystal molecules in the polarization layers L1 and L3 form internal electric fields in response to an AC driving waveform applied to the LCD panel. The embodiment of FIG. 5 relaxes these internal electric fields, to provide a projection LCD that employs no polarizing film and provides bright and stable images.

Attenuating the internal electric fields produced by the polarization layers solves the two problems of the phase transition LCD, i.e., (1) the phase transition LCD has a relatively high driving voltage of 25 to 30V so that it cannot be driven with practical amorphous silicon TFTs whose driving voltage is about 10V, and (2) the electro-optic hysteresis of phase transition of liquid crystal puts a limit on the available intensity level.

The other two problems of the phase transition LCD, i.e., (3) changing the liquid crystal material to another to drive the LCD at about 10V provides substantially no contrast, and (4) changing the liquid crystal material to another to drive the LCD at about 10V makes the response time to long to display video images. Techniques of solving these problems will be explained.

The response time and contrast of the phase transition liquid crystal are mainly dependent on the helical pitches of a helical structure of the cholesteric phase. The smaller the helical pitches, the larger a scattering domain to strongly scatter light to improve the contrast. When the helical pitches are properly small, the cholesteric-nematic phase transition smoothly takes place to shorten the response time. Reducing the helical pitches, however, increases torque, i.e., an electric field applied to transit the cholesteric phase to the nematic phase, thereby increasing the driving voltage.

Accordingly, all of the problems will be solved and a projection LCD that provides quality images will be materialized if helical pitches proper for securing sufficient contrast and response speed are found and if the driving voltage is reduced.

To reduce the driving voltage of the phase transition liquid crystal, the inventors have examined a technique of removing the internal electric fields produced in the liquid crystal and have found that the internal electric fields are removable to lower the driving voltage by driving the liquid crystal with a waveform having pauses as shown in FIG. 5 instead of the conventional TFT driving waveform of FIG. 3. The period of the pause extends only long enough to relax the internal electric fields caused by electron polarization in the liquid crystal. Generally, a sufficient period for the pause is about several tens of nanoseconds. Such a very short pause causes substantially no decrease in the effective voltage applied to the liquid crystal. Accordingly, there will be no decrease in a response speed.

Tests carried out according to the present invention will be explained in comparison with the prior art.

Glass substrates each of the size of 50×60×1.1 (thick) mm each having a transparent electrode of 20 mm in diameter were prepared. The substrates were washed. A polyimide coating liquid was applied to the substrates by spin coater. The substrates were baked for one hour in a nitrogen (N2) gas at 220 degrees centigrade, to form liquid crystal orientation films. Silica balls having an average diameter of 4.0 micrometers were sprayed over the substrates. The substrates were adhered to each other to form cells. Cholesteric-nematic phase transition liquid crystal was injected into the cells to form phase transition liquid crystal cells. The cholesteric-nematic phase transition liquid crystal was prepared from a nematic liquid crystal mixture, which was mainly composed of cyclohexane-based liquid crystal having $\Delta\epsilon$ of 8.5 and $\Delta n$ of 0.12 and fluorine substitution biphenyl liquid crystal, and chiral nematic liquid crystal of 8.8 weight percent having natural spiral pitches of 0.01 micrometers.

Figure 6A:
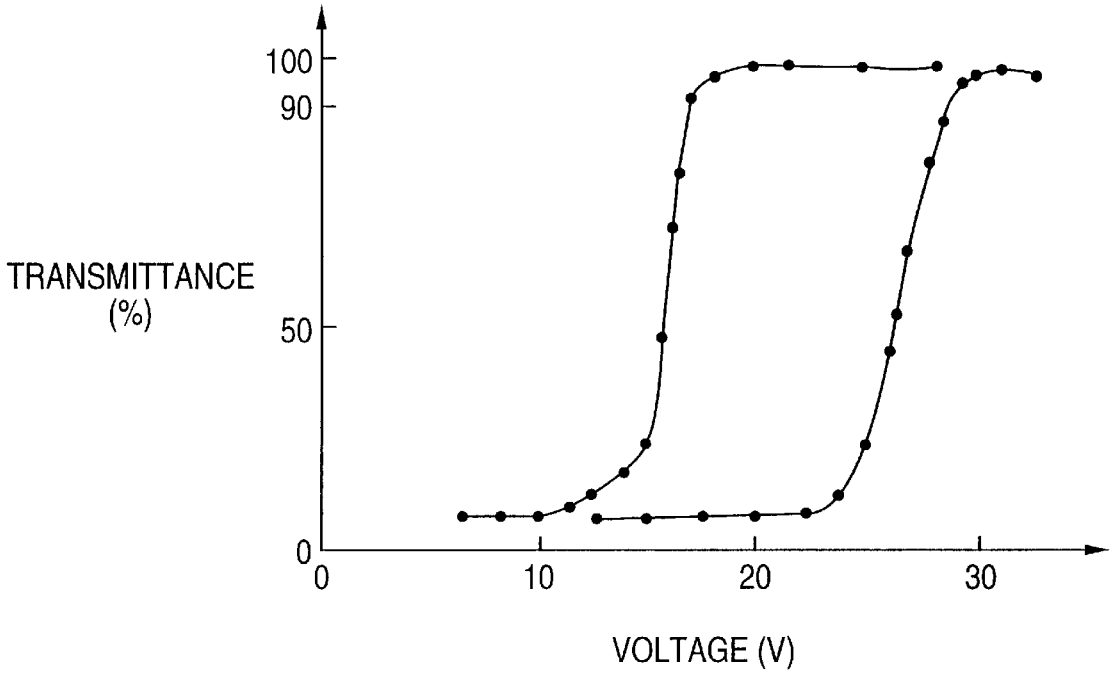
FIGS. 6A and 6B are comparison of the LCD according to the present invention and the conventional LCD in terms of the quantity of transmitted light and a driving voltage.

FIG. 6A shows a relationship between a voltage and a light transmission factor obtained when the conventional driving waveform of FIG. 3 having a continuous rectangular shape is applied to the phase transition liquid crystal. Hysteresis is conspicuous in the figure, and the driving voltage is above 20V. Accordingly, the liquid crystal cannot be driven with TFTs.

Figure 6B:
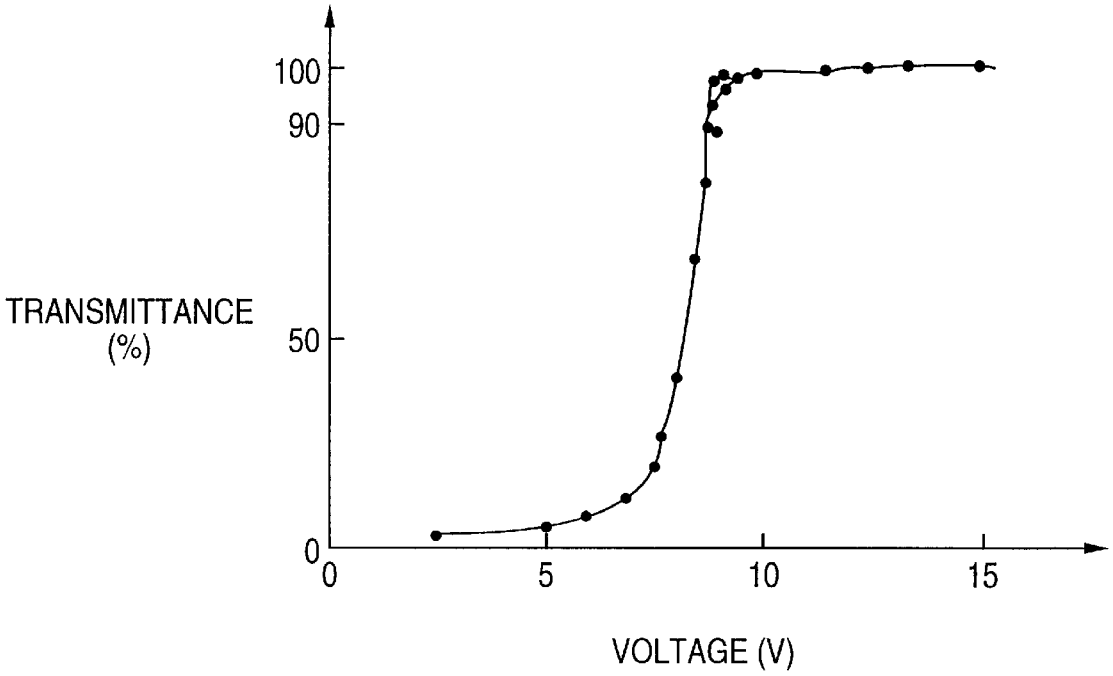

FIG. 6B shows a relationship between a voltage and a light transmission factor when the driving waveform of FIG. 5 involving the pauses T3 and T4 according to the present invention is applied to the phase transition liquid crystal. As is apparent in the figure, the present invention causes substantially no hysteresis. In addition, the waveform of the present invention involves a driving voltage of less than 10V, which is proper for TFTs.

Figure 7:
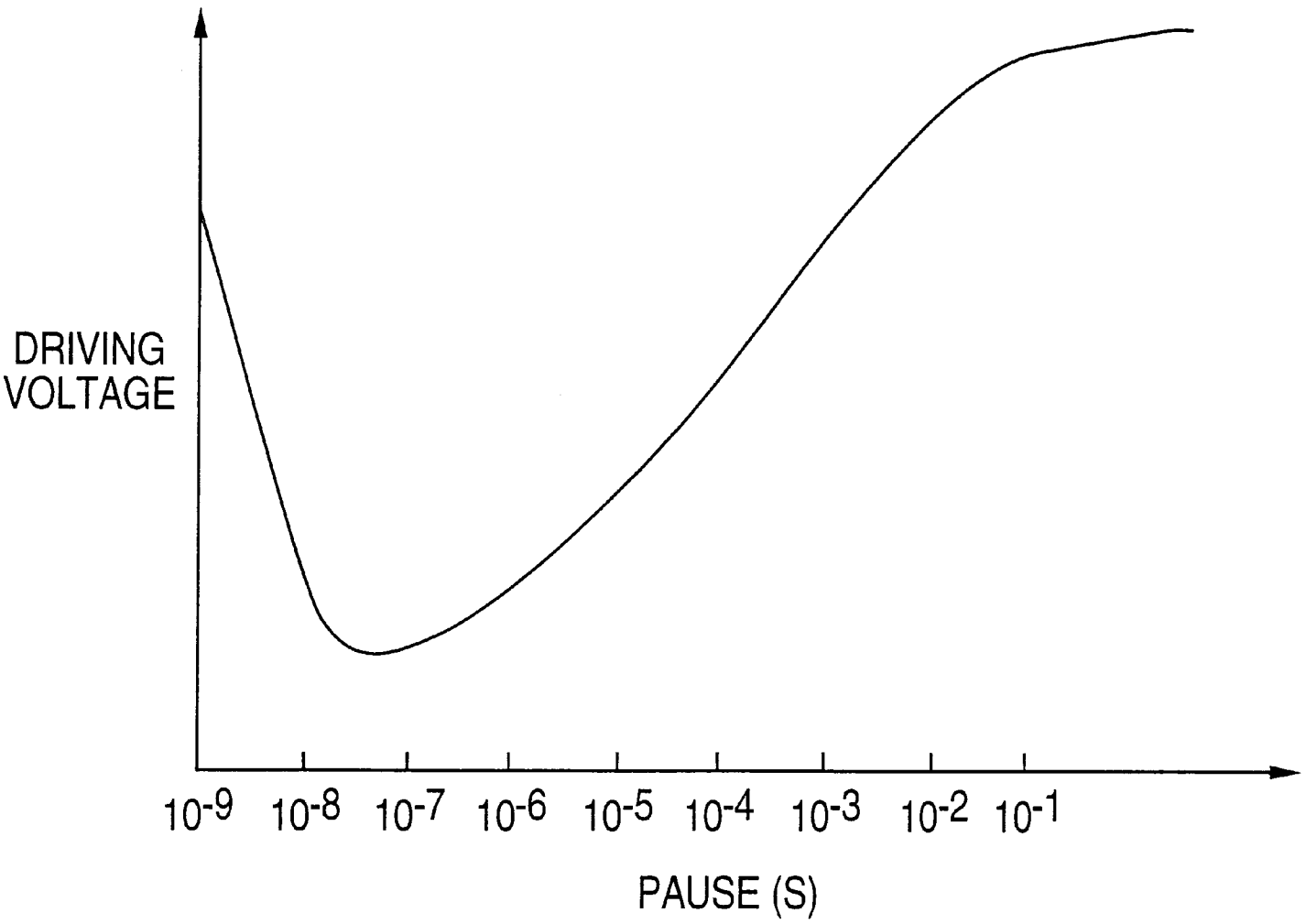
FIG. 7 shows a relationship between a driving voltage and the period of a pause according to the present invention.

FIG. 7 shows a relationship between a driving voltage and the period of a pause in an LCD according to an embodiment of the present invention. A pause of about several nanoseconds ($10^{-9}$ seconds) is insufficient to attenuate depolarization electric fields and lower the driving voltage. When the pause is about several tens of nanoseconds ($10^{-8}$ seconds) to several hundreds of nanoseconds ($10^{-7}$ seconds), the depolarization electric fields are sufficiently attenuated, to thereby sufficiently lower the driving voltage. When the pause is more than several microseconds ($10^{-6}$ seconds), the effective voltage decreases to again increase the driving voltage.

Figure 8:
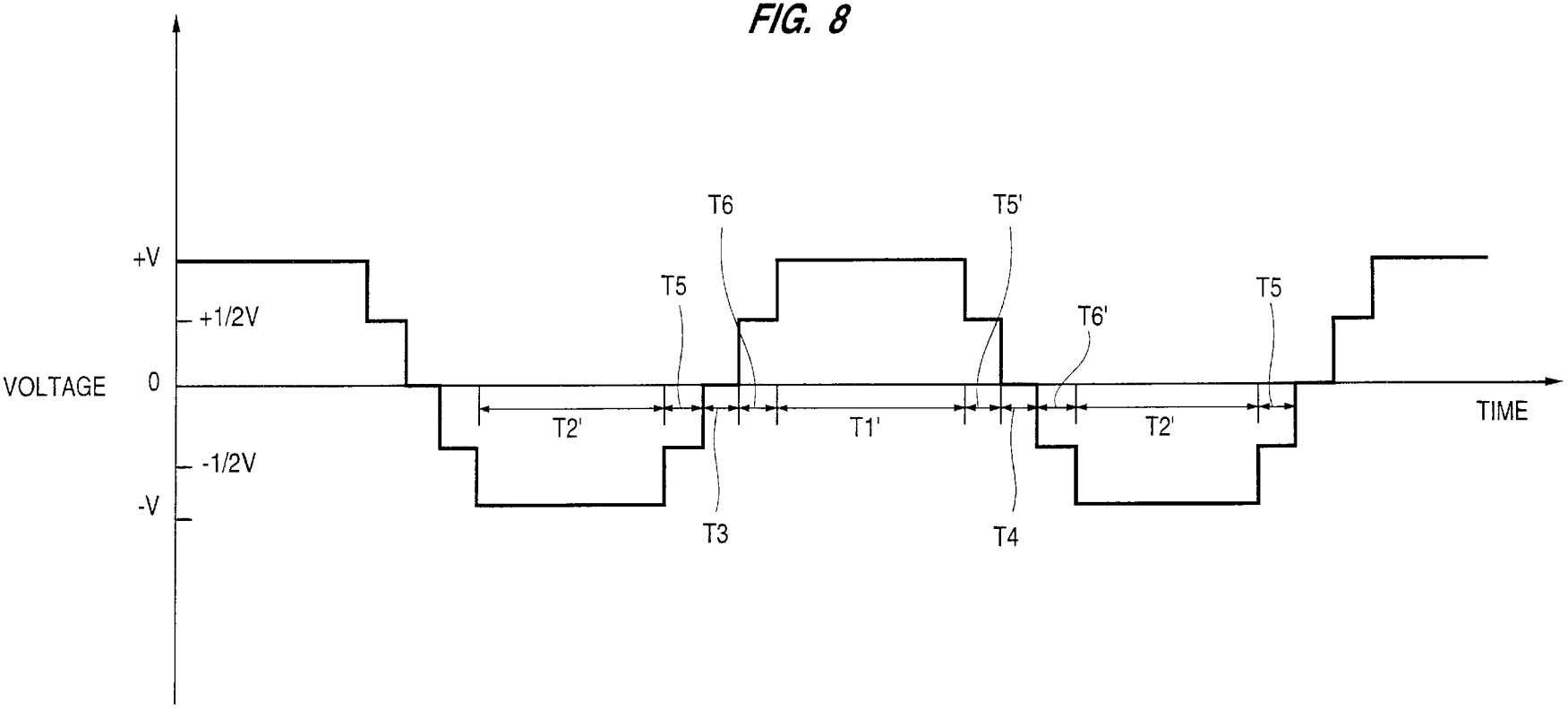
FIG. 8 shows a waveform for driving an LCD according to another embodiment of the present invention.
Figure 9:
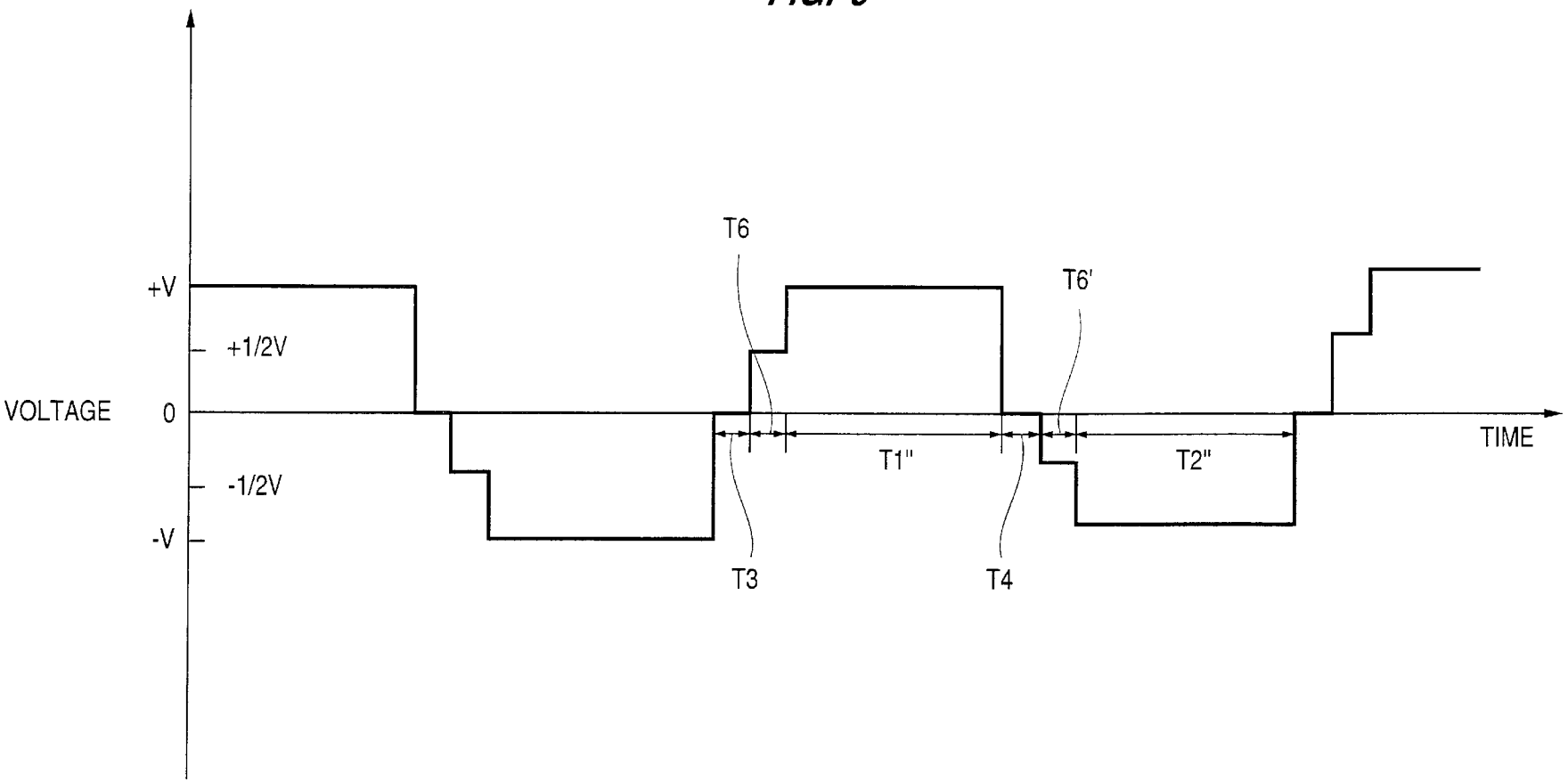
FIG. 9 shows a waveform for driving an LCD according to still another embodiment of the present invention.

FIG. 8 shows a waveform for driving an LCD according to another embodiment of the present invention, and FIG. 9 shows a waveform for driving an LCD according to still another embodiment of the present invention. The driving waveforms of FIGS. 8 and 9 having pauses provide the same effect as the driving waveform of FIG. 5. The waveforms of FIGS. 8 and 9 are sustain pulses applied after write pulses.

In the AC driving waveform of FIG. 8, driving voltage limiting periods T5 and T6 to limit peak values of the waveform, are inserted just before and after a pause T3, and driving voltage limiting periods T5' and T6', to limit peak values of the waveform, are inserted just before and after a pause T4.

Namely, the driving voltage limiting period T5 to maintain a voltage of −½V is put just before the pause T3 of 0 volts, so that the driving waveform reaches the pause T3 via a period T2' of −V and the driving voltage limiting period T5 of −½V. The driving voltage limiting period T6 of +½V is set just after the pause T3 of zero volts, so that the driving waveform reaches a period T1' of +V via the pause T3 and the driving voltage limiting period T6.

In the AC driving waveform of FIG. 9, a driving voltage limiting period T6 to limit a peak value of the driving waveform is inserted just after a pause T3, and a driving voltage limiting period T6' to limit a peak value of the driving waveform is inserted just after a pause T4.

Namely, the driving voltage limiting period T6 of +½V is inserted just after the pause T3 of zero volts, so that the driving waveform reaches a period T1" of +V via the pause T3 and the driving voltage limiting period T6. The driving voltage limiting period T6' of −½V is inserted just after the pause T4 of zero volts, so that the driving waveform reaches a period T2" of −V via the pause T4 and the driving voltage limiting period T6.

Changing the AC driving waveform in steps of T5, T3, and T6 (T5', T4, and T6') of FIG. 8, or in steps of T3 and T6 (T4 and T6') of FIG. 9 will suppress the hysteresis and enable TFTs to drive the LCD, similar to the embodiment of FIG. 5.

According to the embodiments of FIGS. 8 and 9, the levels of the driving voltage limiting periods T5, T5', T6, and T6' are intermediate values (+½V, −½V) of the peak values of the AC driving waveforms. These levels may be shifted toward the high voltage side or toward the low voltage side from the intermediate levels.

In this way, the embodiments of the present invention insert pauses each properly covering a period for relaxing the internal electric fields produced by electron polarization, to thereby lower the driving voltage and suppress hysteresis.

According to driving tests of LCD panels with waveforms involving such pauses, a phase transition period from a cholesteric phase to a nematic phase was 12 msec and that from a nematic phase to a cholesteric phase was 16 msec. These periods are sufficiently short to display video images. According to the tests, a luminance ratio (scattering to transmission) was 90:1 in an optical system with a view angle of three degrees. Namely, sufficient contrast was obtained.

Figure 10:
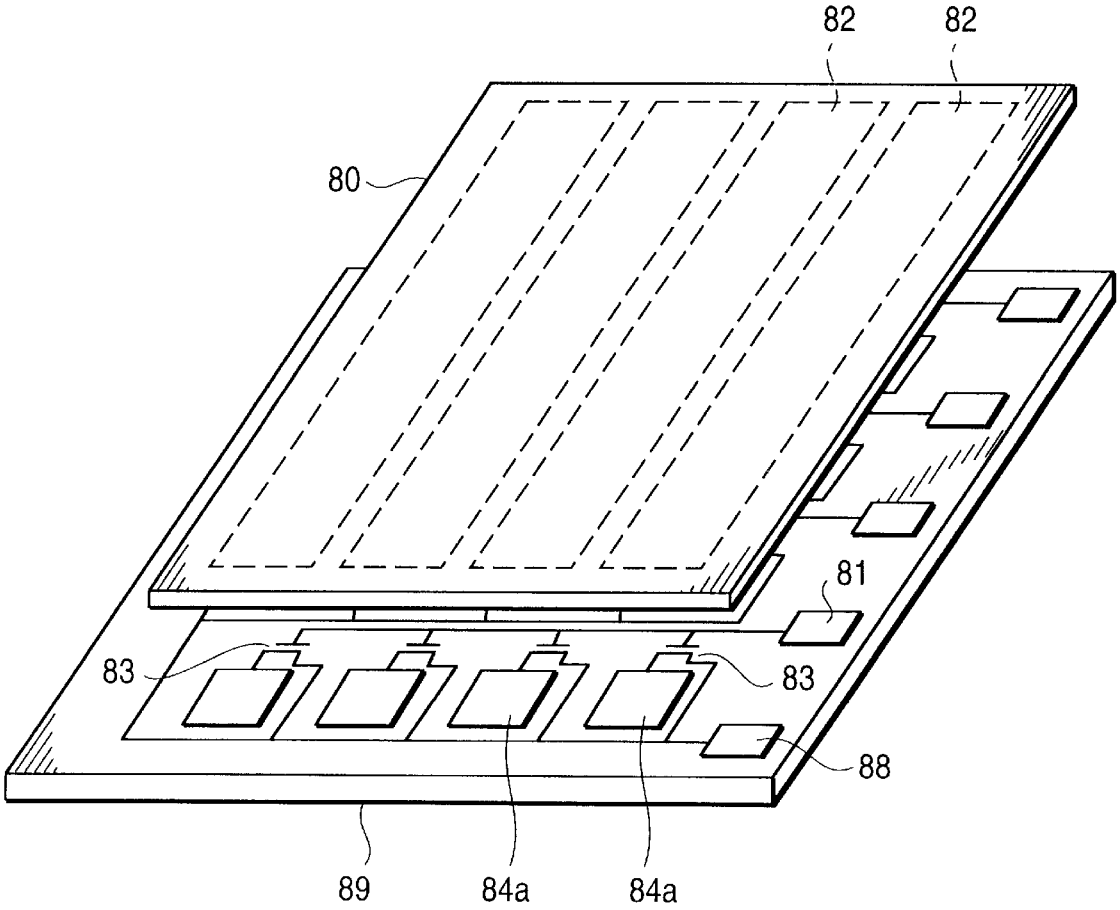
FIG. 10 is a perspective view showing an opposed active matrix LCD panel according to the present invention.
Figure 11:
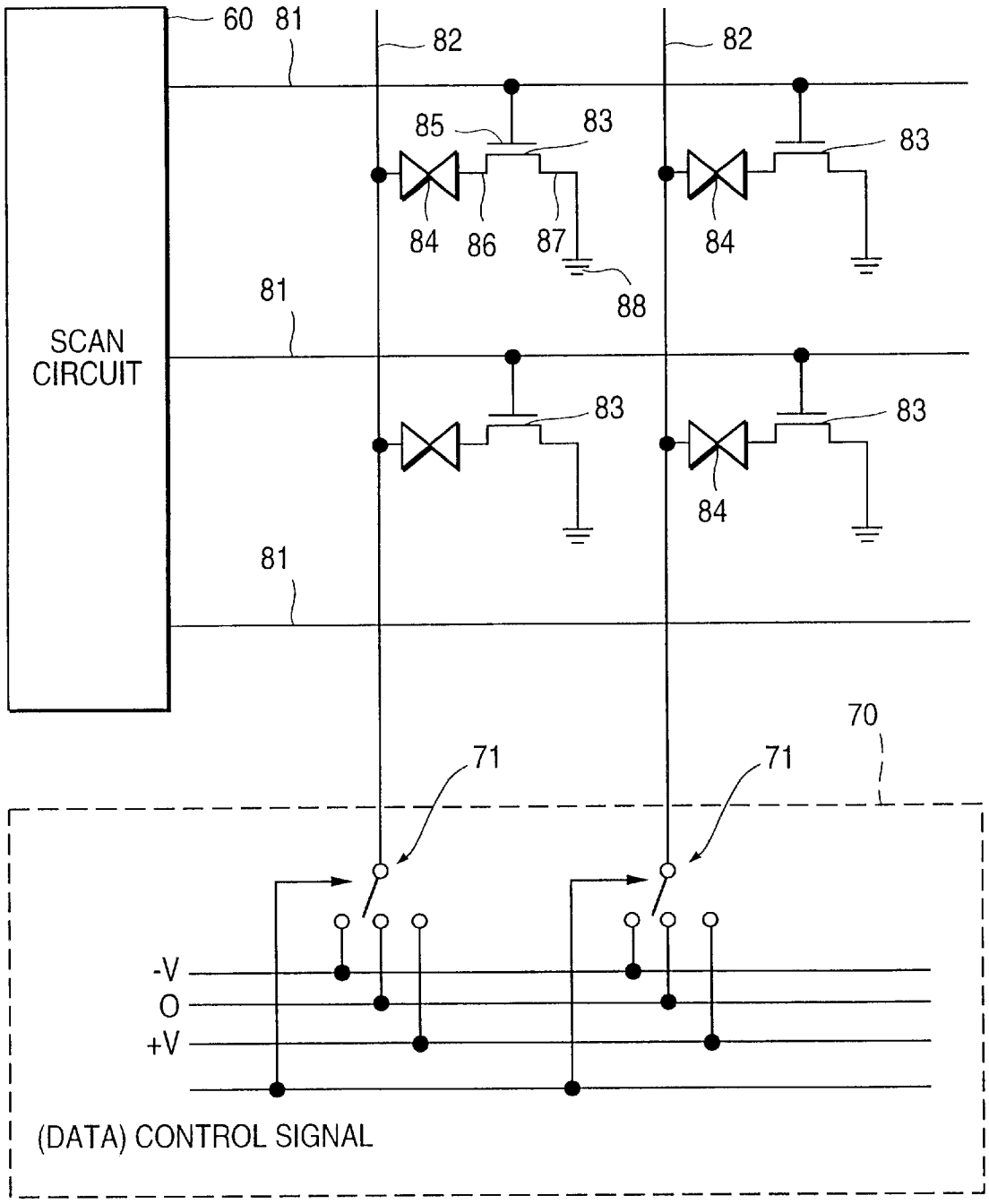
FIG. 11 shows an equivalent circuit of the LCD of FIG. 10 with a drive circuit.

FIG. 10 is a perspective view showing a panel of an opposed active matrix LCD according to the present invention, and FIG. 11 shows an equivalent circuit of the LCD of FIG. 10 with a drive circuit.

In FIG. 10, the opposed active matrix LCD has glass substrates 80 and 89 that face each other to hold liquid crystal (not shown) therebetween. The glass substrate (TFT substrate) 89 supports scan bus lines 81, TFTs 83, display electrodes 84*a* each forming a liquid crystal cell 84, and a reference potential supplying bus line 88 (a ground line in FIG. 11). The other glass substrate (opposed substrate) 80 supports data bus lines 82. Between the data bus lines 82 and the display electrodes 84*a*, the liquid crystal is sealed to form the liquid crystal cells 84. Each of the liquid crystal cells 84 is connected to the data bus line 82 and a drain (or source) 86 of the TFT 83. A gate 85 of the TFT 83 is connected to the scan bus line 81, and a source (or drain) 87 of the TFT 83 is connected to the reference potential supplying bus line 88.

In FIG. 11, numeral 60 is a scan circuit and 70 is a hold circuit. The hold circuit 70 has switches 71 provided for respective data bus lines 82. Each of the switches 71 switches a voltage applied to the liquid crystal cells 84 among, for example, −V, 0, and +V in response to external control signals (display data). Accordingly, any one of the driving waveforms of FIGS. 5 to 7 is applicable to the liquid crystal cells 84. When applying one of the driving waveforms of FIGS. 8 and 9, it is necessary to prepare voltages of −½V and +½V and control the timing (the driving voltage limiting periods T5, T6, T5', and T6') of applying the voltages to the liquid crystal cells 84.

The present invention is applicable not only for the opposed active matrix LCDs but also for standard active matrix LCDs.

Figure 12:
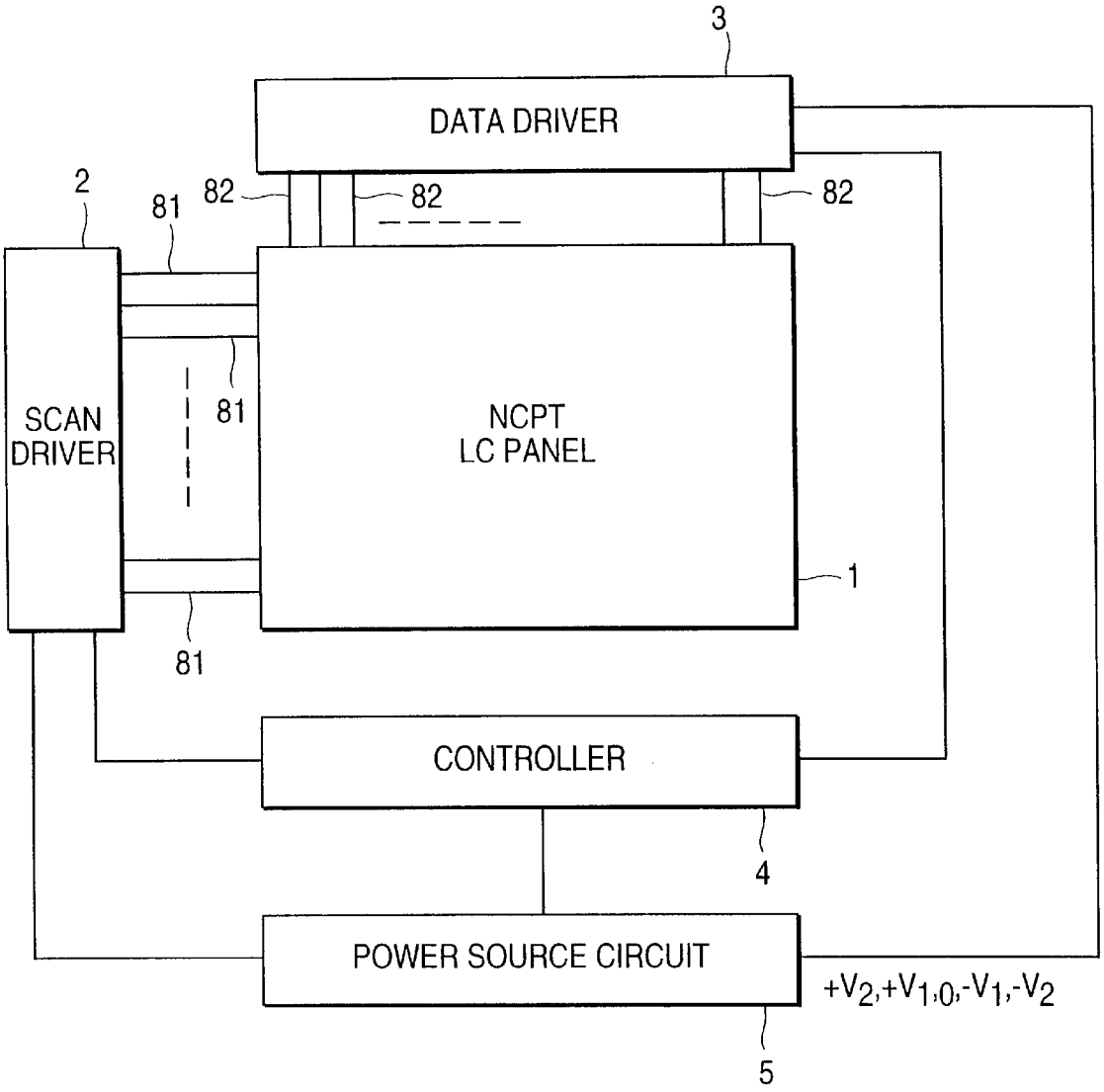
FIG. 12 is a block diagram schematically showing an LCD according to the present invention.

FIG. 12 is a block diagram schematically showing an LCD according to the present invention. Numeral 1 is an LCD panel employing phase transition liquid crystal, 2 is a scan driver, 3 is a data driver, 4 is a controller, and 5 is a power source circuit. The scan driver 2 corresponds to the scan circuit 60 of FIG. 11, and the data driver 3 corresponds to the hold circuit 70 of FIG. 11.

Figure 13:
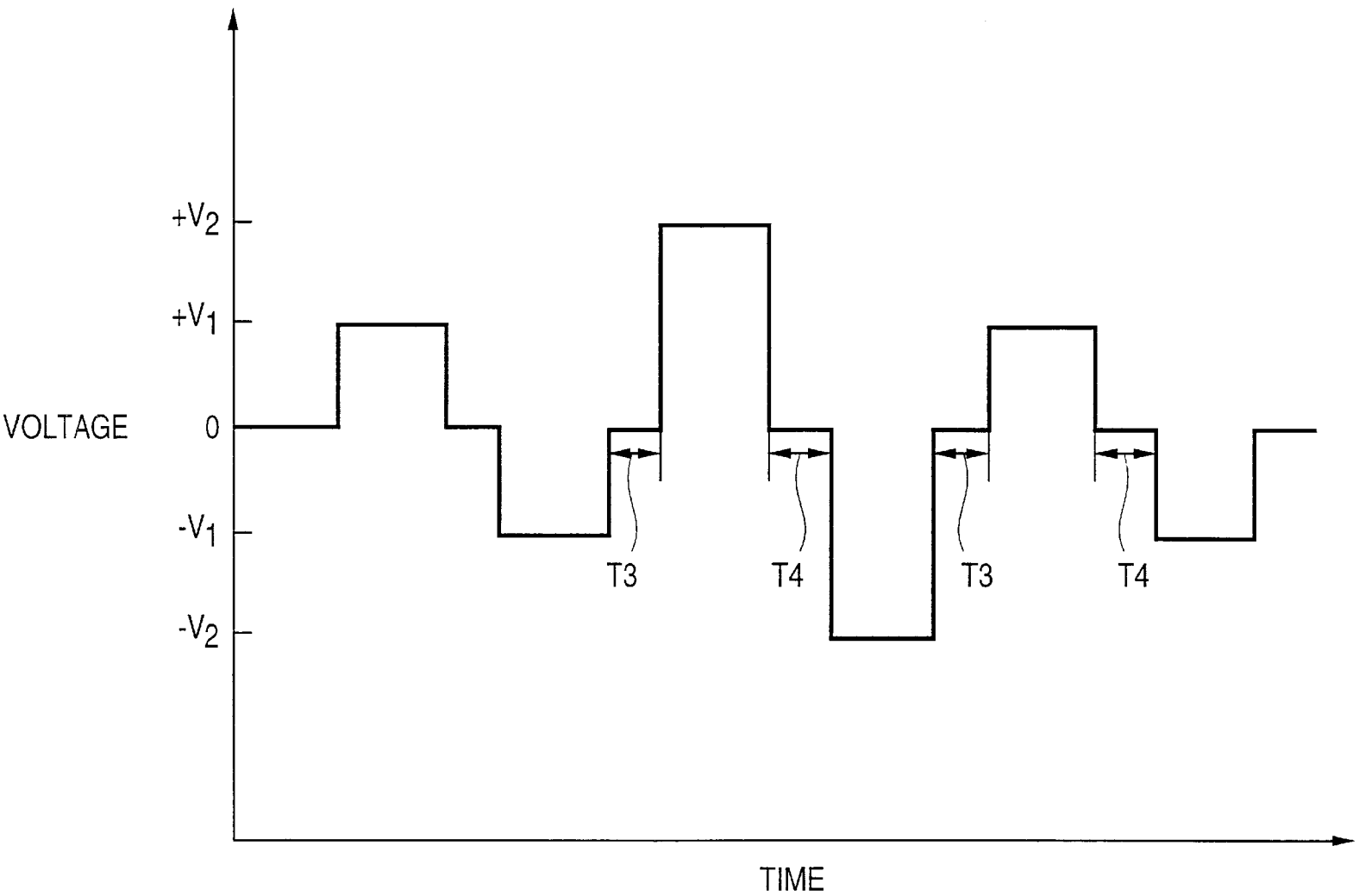
FIG. 13 shows a waveform for driving the LCD of FIG. 12.

FIG. 13 shows an example of an AC waveform for driving the LCD of FIG. 12. This driving waveform involves voltages of +V2, +V1, 0, −V1, and −V2. Pauses T3 and T4 are inserted in the waveform. Namely, the pauses T3 and T4 each of zero volts are inserted in the AC driving waveform of the voltages of +V2, +V1, −V1, and −V2, to relax internal electric fields produced by electric field reactions of molecules of the liquid crystal.

Figure 14:
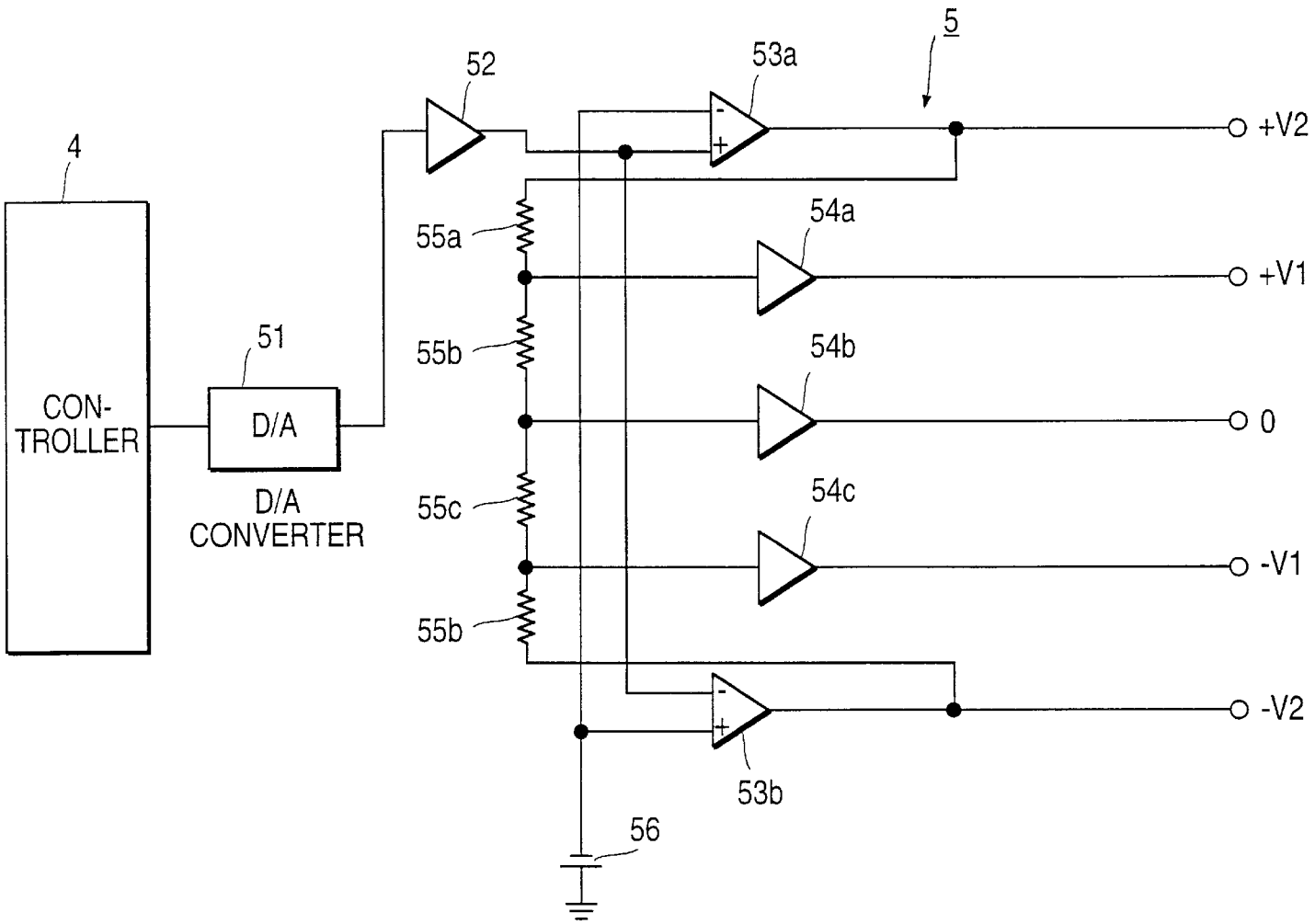
FIG. 14 is a circuit diagram showing an example of a power source circuit of the LCD of FIG. 12.

FIG. 14 is a circuit diagram showing an example of the power source circuit 5 for the LCD of FIG. 12. Numeral 51 is a digital-to-analog converter, 52 and 54*a* to 54*c* are buffer amplifiers, 53*a* and 53*b* are differential amplifiers, 55*a* to 55*d* are resistors, and 56 is a DC power source.

Electric power from the DC power source 56 is supplied to the differential amplifiers 53*a* and 53*b* to provide voltages +V2 and −V2, which are divided by the resistors 55*a* to 55*d*. The divided voltages are passed through the buffer amplifiers 54*a* to 54*c* to provide voltages +V1, 0, and −V1. The voltages +V2, +V1, 0, −V1, and −V2 are supplied to the data driver 3 to drive the liquid crystal cells 84 with a predetermined drive waveform. The power source circuit 5 may be realized in various forms.

As explained above in detail, the present invention provides an LCD employing phase transition liquid crystal to be driven with TFTs and a method of driving the LCD. This LCD can serve as a projection LCD that is bright and stable and does not use a polarizing film.

Many different embodiments of the present invention may be constructed without departing from the spirit and scope of the present invention, and it should be understood that the present invention is not limited to the specific embodiments described in this specification, except as defined in the appended claims.

We claim:

1. A method of driving an active matrix liquid crystal display employing a phase transition liquid crystal by an AC driving waveform, the AC driving waveform causing the phase transition liquid crystal to change from a first phase to a second phase and causing electron polarization in the phase transition liquid crystal which produces internal electric fields in the phase transition liquid crystal when the phase transition liquid crystal changes from the first phase to the second phase, the method comprising:

attenuating the internal electric fields in the phase transition liquid crystal by inserting pauses in the AC driving waveform, the pauses representing periods in which approximately zero volts are applied to the liquid crystal display and which are greater than or equal to $10^{-8}$ seconds and less than or equal to $10^{-7}$ seconds.

2. A method as claimed in claim 1, further comprising:

inserting the pauses in the AC driving waveform while a sustain pulse is being applied after a write pulse.

3. A method as claimed in claim 1, further comprising:

inserting driving voltage limiting periods in the AC driving waveform just before the pauses, to limit the peak values of the AC driving waveform.

4. A method as claimed in claim 3, wherein voltage levels of the respective driving voltage limiting periods are intermediate values of the peak values of the AC driving waveform.

5. A method as claimed in claim 1, further comprising:

inserting driving voltage limiting periods in the AC driving waveform just after the pauses, to limit peak values of the AC driving waveform.

6. A method as claimed in claim 5, wherein voltage levels of the respective driving voltage limiting periods are intermediate values of the peak values of the AC driving waveform.

7. An active matrix liquid crystal display, comprising:

a first glass substrate;

a second glass substrate;

phase transition liquid crystal sealed between the first glass substrate and the second glass substrate, the phase transition liquid crystal adjacent to the first glass substrate to form a first interface and adjacent to the second glass substrate to form a second interface;

thin film transistors which drive the phase transition liquid crystal;

AC drive means for driving the phase transition liquid crystal with an alternating AC waveform; and electric field attenuation means for attenuating internal electric fields produced when molecules of the phase transition liquid crystal react to electric fields at the first interface and the second interface, wherein the electric field attenuation means inserts pauses in the AC waveform to attenuate the internal electric fields, the pauses representing periods in which approximately zero volts are applied to the phase transition liquid crystal and which are greater than or equal to $10^{-8}$ seconds and less than or equal to $10^{-7}$ seconds.

8. An active matrix liquid crystal display as claimed in claim 7, wherein the pauses are inserted in the AC waveform while a sustain pulse is being applied after a write pulse.

9. An active matrix liquid crystal display as claimed in claim 7, wherein driving voltage limiting periods are inserted in the AC waveform just before the pauses, to limit peak values of the AC waveform.

10. An active matrix liquid crystal display as claimed in claim 9, wherein voltage levels of the driving voltage limiting periods are intermediate values of the peak values of the AC waveform.

11. An active matrix liquid crystal display as claimed in claim 7, wherein driving voltage limiting periods are inserted in the AC waveform just after the pauses, to limit peak values of the AC waveform.

12. An active matrix liquid crystal display as claimed in claim 11, wherein voltage levels of the driving voltage limiting periods are intermediate values of the peak values of the AC waveform.

13. A method of driving an active matrix liquid crystal display employing a phase transition liquid crystal by an AC driving waveform, the AC driving waveform causing the phase transition liquid crystal to change from a first phase to a second phase and causing electron polarization which produces internal electric fields in the phase transition liquid crystal in the phase transition liquid crystal when the phase transition liquid crystal changes from the first phase to the second phase, the method comprising:

attenuating the internal electric fields by forming the AC driving waveform so that the AC driving waveform comprises pauses representing periods in which approximately zero volts are applied to the liquid crystal display and which are greater than or equal to $10^{-8}$ seconds and less than or equal to $10^{-7}$ seconds.

14. A method as claimed in claim 13, further comprising:

forming the AC driving waveform while a sustain pulse is being applied to the liquid crystal display after a write pulse.

15. A method as claimed in claim 13, further comprising:

forming the AC driving waveform so that the AC driving waveform comprises driving voltage limiting periods just before the pauses, to limit the peak values of the AC driving waveform.

16. A method as claimed in claim 15, wherein voltage levels of the driving voltage limiting periods are intermediate values of the peak values of the AC driving waveform.

17. A method as claimed in claim 13, further comprising:

forming the AC driving waveform so that the AC driving waveform comprises driving voltage limiting periods just after the pauses, to limit peak values of the AC driving waveform.

18. A method as claimed in claim 17, wherein voltage levels of the driving voltage limiting periods are intermediate values of the peak values of the AC driving waveform.

19. An active matrix liquid crystal display, comprising:

a first glass substrate;

a second glass substrate;

a cholesteric-nematic phase transition liquid crystal having a cholesteric phase for scattering light and a nematic phase for transmitting light in accordance with a voltage applied thereto, the cholesteric phase and the nematic phase each representing a respective stable state of the phase transition liquid crystal, the phase transition liquid crystal sealed between the first glass substrate and the second glass substrate, the phase transition liquid crystal adjacent to the first glass substrate to form a first interface and adjacent to the second glass substrate to form a second interface;

AC drive means for driving the phase transition liquid crystal with an alternating AC waveform; and electric field attenuation means for attenuating internal electric fields produced when molecules of the phase transition liquid crystal react to electric fields at the first interface and the second interface, wherein the electric field attenuation means inserts pauses in the AC waveform to attenuate the internal electric fields, the pauses representing periods in which approximately zero volts are applied to the phase transition liquid crystal and which are greater than or equal to $10^{-8}$ seconds and less than or equal to $10^{-7}$ seconds.

20. An active matrix liquid crystal display as claimed in claim 19, wherein the pauses are inserted in the AC waveform while a sustain pulse is being applied after a write pulse.

21. An active matrix liquid crystal display as claimed in claim 19, wherein the electric field attenuation means inserts driving voltage limiting periods in the AC waveform just before the pauses, to limit peak values of the AC waveform.

22. An active matrix liquid crystal display as claimed in claim 21, wherein voltage levels of the driving voltage limiting periods are intermediate values of the peak values of the AC waveform.

23. An active matrix liquid crystal display as claimed in claim 19, wherein the electric field attenuation means inserts driving voltage limiting periods in the AC waveform just after the pauses, to limit peak values of the AC waveform.

24. An active matrix liquid crystal display as claimed in claim 23, wherein voltage levels of the driving voltage limiting periods are intermediate values of the peak values of the AC waveform.

25. A method of driving an active matrix liquid crystal display by an AC driving waveform, the method comprising:

providing a liquid crystal display with a cholesteric-nematic phase transition liquid crystal having a cholesteric phase for scattering light and a nematic phase for transmitting light in accordance with a voltage applied thereto, the cholesteric phase and the nematic phase each representing a respective stable state of the phase transition liquid crystal;

forming the AC driving waveform so that the AC driving waveform comprises pauses representing periods in which approximately zero volts are applied to the liquid crystal display and which are greater than or equal to $10^{-8}$ seconds and less than or equal to $10^{-7}$ seconds, the pauses acting to attenuate internal electric fields produced in the phase transition liquid crystal when the phase transition liquid crystal changes from the cholesteric phase to the nematic phase and from the nematic phase to the cholesteric phase; and driving the liquid crystal display by the AC driving waveform.

26. A method as claimed in claim 25, further comprising:

forming the AC driving waveform while a sustain pulse is being applied to the liquid crystal display after a write pulse.

27. A method as claimed in claim 25, further comprising:

forming the AC driving waveform so that the AC driving waveform comprises driving voltage limiting periods just before the pauses, to limit the peak values of the AC driving waveform.

28. A method as claimed in claim 27, wherein voltage levels of the driving voltage limiting periods are intermediate values of the peak values of the AC driving waveform.

29. A method as claimed in claim 25, further comprising:

forming the AC driving waveform so that the AC driving waveform comprises driving voltage limiting periods just after the pauses, to limit peak values of the AC driving waveform.

30. A method as claimed in claim 29, wherein voltage levels of the driving voltage limiting periods are intermediate values of the peak values of the AC driving waveform.

* * * * *